US008552655B2

(12) United States Patent
Ono

(10) Patent No.: US 8,552,655 B2
(45) Date of Patent: Oct. 8, 2013

(54) IMAGE DISPLAY APPARATUS

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 201 days.

(21) Appl. No.: 13/299,622

(22) Filed: Nov. 18, 2011

(65) Prior Publication Data

US 2012/0062130 A1 Mar. 15, 2012

Related U.S. Application Data

(63) Continuation of application No. PCT/JP2010/003493, filed on May 25, 2010.

(30) Foreign Application Priority Data

May 25, 2009 (JP) ..... 2009-125629

(51) Int. Cl.
*H05B 37/02* (2006.01)

(52) U.S. Cl.
USPC ..... 315/187; 315/192; 345/76; 345/77

(58) Field of Classification Search
None
See application file for complete search history.

(56) References Cited

U.S. PATENT DOCUMENTS

| | | | | |
|---|---|---|---|---|
| 7,166,966 | B2 * | 1/2007 | Naugler et al. | 315/149 |
| 2004/0113543 | A1 * | 6/2004 | Daniels | 313/504 |
| 2005/0162353 | A1 | 7/2005 | Kanda | |
| 2007/0285359 | A1 | 12/2007 | Ono | |
| 2008/0030436 | A1 | 2/2008 | Iida et al. | |
| 2009/0091521 | A1 | 4/2009 | Kanda | |
| 2010/0073358 | A1 | 3/2010 | Ozaki | |
| 2010/0277449 | A1 | 11/2010 | Kanda | |

FOREIGN PATENT DOCUMENTS

| | | |
|---|---|---|
| JP | 2004-226543 | 8/2004 |
| JP | 2005-208346 | 8/2005 |
| JP | 2007-310034 | 11/2007 |
| JP | 2008-033193 | 2/2008 |
| JP | 2008-122497 | 5/2008 |
| JP | 2008-145647 | 6/2008 |
| JP | 2010-097187 | 4/2010 |

OTHER PUBLICATIONS

International Search Report of PCT/JP2010/003493, dated Oct. 8, 2010.

* cited by examiner

*Primary Examiner* — Crystal L Hammond
(74) *Attorney, Agent, or Firm* — Greenblum & Bernstein, P.L.C.

(57) ABSTRACT

An image display apparatus according to an implementation of the present invention includes: pixel circuits disposed in rows and columns; first power lines and control lines disposed in respective rows; a third power line; second switching transistors disposed at least one for each of the rows and each having a gate terminal connected to the control line disposed in the corresponding row, one of a source terminal and a drain terminal connected to the first power line disposed in the corresponding row, and the other of the source terminal and the drain terminal connected to the third power line; and a power supply unit which supplies the same voltage to the first power lines and the third power line when the second switching transistors are turned ON.

13 Claims, 14 Drawing Sheets

IMAGE DISPLAY APPARATUS

CROSS REFERENCE TO RELATED APPLICATION

This is a continuation application of PCT application No. PCT/JP2010/003493 filed on May 25, 2010, designating the United States of America.

BACKGROUND OF THE INVENTION (1) Field of the Invention

The present invention relates to image display apparatuses and particularly to an image display apparatus using a current-driven luminescence element and to a method of driving the image display apparatus.

(2) Description of the Related Art

An image display apparatus using an organic electroluminescence (EL) element (an organic EL display apparatus) is known as an example of an image display apparatus using a current-driven luminescence element. An organic EL display apparatus using such a self-luminous organic EL element does not require a backlight necessary for a liquid-crystal display apparatus and is most suitable when a lower-profile apparatus is desired. Since there is no limit on a viewing angle of an organic EL display apparatus, organic EL apparatuses are expected as next-generation display apparatuses to be put to practical use. An organic EL element used in an organic EL display apparatus is different from a liquid-crystal cell which is controlled by a voltage applied to the liquid-crystal cell in that luminance of each luminescence element is controlled by a value of a current flowing through the luminescence element.

In an organic EL display apparatus, organic EL elements each constituting a pixel are generally disposed in a matrix. Known organic EL display apparatuses include passive matrix organic EL display apparatuses and active matrix organic EL display apparatuses.

A passive matrix organic EL display apparatus has an organic EL element provided at each of intersections of a plurality of row electrodes (scanning lines) and a plurality of column electrodes (data lines) and drives the organic EL elements by applying a voltage corresponding to a data signal between a selected one of the row electrodes and the plurality of column electrodes.

An active matrix organic EL display apparatus has a switching thin film transistor (TFT: Thin Film Transistor) provided at each of intersections of a plurality of row electrodes and a plurality of data lines, and a gate of a drive element is connected to each switching TFT. The active matrix organic EL display apparatus inputs a data signal from a signal line to the corresponding drive element by turning on the switching TFT through a selected one of the scanning lines. An organic EL element is driven by the drive element.

An active matrix organic EL display apparatus can cause organic EL elements to generate photons until a next scanning (selection) operation, unlike a passive matrix organic EL display apparatus whose organic EL elements connected to respective row electrodes (scanning line) generate photons only during a period when the scanning line is selected. Even an increase in duty ratio does not invite a reduction in luminance of the display. An active matrix organic EL display apparatus can thus be driven at a low voltage, which allows a reduction in power consumption.

However, an active matrix organic EL display apparatus suffers from the problem that even with the same data signal supplied, organic EL elements are different in luminance among pixels due to variation in characteristics of drive transistors, i.e., unevenness in luminance shows up.

To cope with the problem, a method for compensating for variation in characteristics of pixels is disclosed as a method for compensating for unevenness in luminance due to variation in characteristics of drive transistors (see, e.g., Japanese Unexamined Patent Application Publication No. 2008-033193 (hereinafter referred to as Patent Document 1) and Japanese Unexamined Patent Application Publication No. 2007-310034 (hereinafter referred to as Patent Document 2).

A display apparatus disclosed in Patent Document 1 will be described below.

FIG. 13 is a diagram showing a configuration of a display apparatus 100 disclosed in Patent Document 1.

A pixel array unit 102 includes rows of scanning lines WSL, columns of signal lines DTL, a matrix of pixels 101, each of which is disposed at an intersection of one of the scanning lines WSL and one of the signal lines DTL, and power lines DSL which are disposed for respective rows of the pixels 101. Furthermore, the display apparatus 100 includes a main scanner 104 which sequentially supplies control signals to the scanning lines WSL in respective horizontal cycles (1H) and line-sequentially scans the pixels 101, one row at a time, a power supply scanner 105 which supplies a power supply voltage that is switched between a first voltage and a second voltage to the power lines DSL in step with the line-sequential scanning, and a signal selector 103 which switches between a signal voltage serving as a video signal and a reference voltage and supplies one of the voltages to the columns of signal lines during each horizontal period (1H) in step with the line-sequential scanning.

Each pixel 101 includes a luminescence element 3D, typified by, e.g., an organic EL element, a transistor 3A for sampling, a transistor 3B for driving, and a holding capacitor 3C.

In the transistor 3A for sampling, a gate is connected to the corresponding scanning line WSL, one of a source and a drain is connected to the corresponding signal line DTL, and the other is connected to a gate of the transistor 3B for driving.

In the transistor 3B for driving, one of a source and a drain is connected to the luminescence element 3D, and the other is connected to the corresponding power line DSL.

A cathode of the luminescence element 3D is connected to ground wiring 3H. The holding capacitor 3C is connected between the source and the gate of the transistor 3B for driving.

With the above-described configuration, the transistor 3A for sampling is brought into conduction in response to a control signal supplied from the scanning line WSL, samples a signal voltage supplied from the signal line DTL, and holds the signal voltage in the holding capacitor 3C. The transistor 3B for driving is supplied with a current from the power line DSL at a first potential and feeds a drive current through the luminescence element 3D according to the signal voltage held in the holding capacitor 3C.

During a time period when the power line DSL is at the first potential and the signal line DTL is at the reference voltage, the main scanner 104 outputs a control signal for bringing the transistor 3A for sampling into conduction and performs a threshold voltage correction operation for holding a voltage corresponding to a threshold voltage Vth of the transistor 3B for driving in the holding capacitor 3C.

Prior to the above-described threshold voltage correction operation, during a time period when the power line DSL is at a second potential and the signal line DTL is at the reference voltage, the main scanner 104 outputs a control signal to bring the transistor 3A for sampling into conduction, sets the gate of the transistor 3B for driving to the reference voltage, and sets the source to the second potential. Such an operation of resetting a potential of the gate and a potential of the source makes it possible to reliably perform the following threshold voltage correction operation.

As described above, the display apparatus 100 disclosed in Patent Document 1 performs a reset operation before a threshold voltage correction operation by supplying the power lines DSL with the second potential different from the first potential supplied during a normal operation. With this configuration, the display apparatus 100 disclosed in Patent Document 1 can implement a threshold voltage correction operation without adding transistors.

SUMMARY OF THE INVENTION

However, in the display apparatus 100 disclosed in Patent Document 1, a voltage to be supplied to the power line DSL in each row needs to be changed with different timing, which requires the power line DSL to be independent for each row.

For this reason, total wiring resistance of the power lines DSL increases in the conventional display apparatus 100, which causes a problem of voltage fluctuation.

This voltage fluctuation will be described in detail below. The description will be given in the context of a case where the display apparatus 100 includes 2 k columns of the pixels 101.

FIG. 14 is a chart showing a drop in power supply voltage on each power line.

As shown in FIG. 14, wiring resistance Rpix is present between each two adjacent pixels on the power line, and a current ipix corresponding to a luminance value is consumed at the luminescence element of each pixel. For this reason, a voltage drop becomes larger toward the middle of the power line. For example, a voltage drop in the power supply voltage supplied to a pixel Nk located at the middle in a row direction is δV.

FIG. 15 is a chart showing a relationship between a drop in power supply voltage and a current flowing through a luminescence element.

As shown in FIG. 15, when the power supply voltage changes by δV, a drive current of each drive transistor changes, and a current flowing through the corresponding luminescence element changes by δI. This causes a change of an image displayed on the display apparatus 100 from an image originally desired to be displayed.

FIG. 16 shows a screen display example of the display apparatus 100 when there is a drop in power supply voltage.

In the example shown in FIG. 16, an image 150 includes a high-luminance pixel region 151 (with a luminance value of, e.g., 255) and normal-luminance pixel regions 152 and 153 (with a luminance value of, e.g., 80). Since a current consumed by the pixel region 151 where photons are generated with high luminance is large, power supply voltages in the pixel regions 152 are lower than power supply voltages in the pixel regions 153. Accordingly, even when the pixel regions 152 and 153 with the same luminance value (e.g., 80) are to be displayed, luminance values of the actually displayed pixel regions 152 are lower (e.g., 75) than luminance values of the actually displayed pixel regions 153. A large discrepancy in color (crosstalk) thus occurs at a boundary along a row direction between the pixel regions 152 and each pixel region 153.

Note that although a drop in power supply voltage also has different values in a row direction, as shown in FIG. 14, since the drop in power supply voltage in the row direction continuously changes according to a position in the row direction, a user does not feel a strong sense of discomfort. However, at the boundary along the row direction between the pixel regions 152 and each pixel region 153, a drop in power supply voltage has significantly different values, which makes a user feel a strong sense of discomfort.

As described above, the conventional display apparatus 100 brings about a sense of discomfort to a user by a reduction in power supply voltage.

FIG. 15 shows an example in which the drive transistors operate in a saturation region. When the drive transistors operate in a linear region due to a reduction in power supply voltage, the amount δI of change in a current flowing through a luminescence element further increases. This makes occurrence of crosstalk caused by a fluctuation in power supply voltage more prominent.

In consideration of the above-described conventional problems, the present invention has as an object to provide an image display apparatus capable of curbing such crosstalk.

In order to achieve the above object, an image display apparatus according to an aspect of the present invention is an image display apparatus comprising a pixel array unit, and the pixel array unit includes: a plurality of pixels disposed in rows and columns; signal lines disposed in the respective columns; scanning lines, first power lines, and control lines disposed in the respective rows; and a second power line, each of the pixels includes: a first switching transistor having a gate terminal, a source terminal, and a drain terminal, the gate terminal being connected to one of the scanning lines that is disposed in a corresponding one of the rows, and one of the source terminal and the drain terminal being connected to one of the signal lines that is disposed in a corresponding one of the columns; a drive transistor having a gate terminal, a source terminal, and a drain terminal, the gate terminal being electrically connected to the other of the source terminal and the drain terminal of the first switching transistor, and one of the source terminal and the drain terminal being electrically connected to one of the first power lines that is disposed in the corresponding row; and a luminescence element having a first terminal and a second terminal and generating photons according to a value of a current flowing between the first terminal and the second terminal, the first terminal being connected to the second power line, and the second terminal being electrically connected to the other of the source terminal and the drain terminal of the drive transistor, the pixel array unit further includes: a third power line for use in connecting the first power lines to each other along the columns; and second switching transistors disposed at least one for each of the rows and each having a gate terminal, a source terminal, and a drain terminal, the gate terminal being connected to one of the control lines that is disposed in a corresponding one of the rows, one of the source terminal and the drain terminal being connected to one of the first power lines that is disposed in the corresponding row, and the other of the source terminal and the drain terminal being connected to the third power line, the image display apparatus further comprises a power supply unit configured to supply a same voltage to the first power lines and the third power line when the second switching transistors are turned ON and, and the first power lines are connected to each other via the third power line when the second switching transistors are turned ON.

With this configuration, the image display apparatus according to an aspect of the present invention can connect the plurality of first power lines provided for the respective rows to each other by turning on the second switching transistors. Since the image display apparatus according to the aspect of the present invention can reduce a difference in voltage drop between adjacent ones of the first power lines, crosstalk can be curbed. Additionally, the image display apparatus according to the aspect of the present invention can apply different voltages to the plurality of first power lines by turning off the second switching transistors. This allows the image display apparatus according to the aspect of the present invention to perform using the first power lines with different timing for each row.

Furthermore, each of the pixels may further include a capacitive element connected between the gate terminal of the drive transistor and the other of the source terminal and the drain terminal of the drive transistor.

Furthermore, it is possible that the power supply unit is configured to supply a first voltage to the third power line and includes an electric supply line drive unit configured to (i) supply the first voltage to one of the first power lines that is disposed in one of the rows in which one of the control lines is disposed, before a corresponding one of the second switching transistors is turned ON to activate the control line and (ii) supply a second voltage to the first power line disposed in the row in which the control line is disposed, after the second switching transistor is turned OFF to deactivate the control line, the second voltage being different from the first voltage.

With this configuration, the image display apparatus according to an aspect of the present invention can apply the second voltage to the first power lines with different timing for each row. The image display apparatus according to the aspect of the present invention can further curb a reduction in power supply voltage by supplying the first voltage to the first power lines from both of the electric supply line drive unit and the third lines.

Furthermore, it is possible that the power supply unit further includes a voltage generation unit having at least first, second, third, and ground level output terminals and configured to generate the first voltage and the second voltage against a ground level, the third power line is connected to the third output terminal, the electric supply line drive unit is connected to the first output terminal and the second output terminal, the voltage generation unit is configured to output the first voltage to the first output terminal and the third output terminal before the second switching transistors are turned ON, and the electric supply line drive unit is configured to turn the second switching transistors ON while the voltage generation unit outputs the first voltage to the first output terminal and the third output terminal, to cause the power supply unit to supply the same voltage to the first power lines and the third power line.

Furthermore, it is possible that the power supply unit is configured to supply a first voltage to the third power line and includes an electric supply line drive unit configured to (i) place, in a high impedance state, one of the first power lines that is disposed in one of the rows in which one of the control lines is disposed, before a corresponding one of the second switching transistors is turned ON to activate the control line and (ii) supply a second voltage to the first power line disposed in the row in which the control line is disposed, after the second switching transistor is turned OFF to deactivate the control line, the second voltage being different from the first voltage.

With this configuration, the image display apparatus according to an aspect of the present invention can apply the second voltage to the first power lines with different timing for each row. Additionally, the image display apparatus according to the aspect of the present invention can simplify a circuit configuration of the electric supply line drive unit, compared to a case where the electric supply line drive unit selectively supplies the first voltage and the second voltage to the first power lines.

Furthermore, it is possible that the image display apparatus comprises a drive unit including the electric supply line drive unit, wherein the drive unit is further configured to selectively output a reference voltage and a signal voltage to each of the signal lines and output a scanning signal for turning the first switching transistor ON or OFF to each of the signal lines, the second voltage is lower than the reference voltage by a threshold voltage of the drive transistor or more, and the drive unit is configured to perform: a reset operation of setting the gate terminal of the drive transistor at the reference voltage and setting a potential of the other of the source terminal and the drain terminal of the drive transistor to the second voltage by supplying the second voltage to the first power line, supplying the reference voltage to the signal line, and turning the first switching transistor ON; a threshold voltage detection operation of changing a difference in voltage between the gate terminal of the drive transistor and the other of the source terminal and the drain terminal of the drive transistor to a voltage corresponding to the threshold voltage of the drive transistor by supplying the first voltage to the first power line, supplying the reference voltage to the signal line, and turning the first switching transistor ON after the reset operation; and a write operation of setting the difference in voltage between the gate terminal of the drive transistor and the other of the source terminal and the drain terminal of the drive transistor to a sum of the signal voltage and the voltage corresponding to the threshold voltage by supplying the first voltage to the first power line, supplying the signal voltage to the signal line, and turning the first switching transistor ON after the reset operation.

With this configuration, crosstalk can be curbed in an image display apparatus which performs threshold voltage compensation by supplying different voltages to first power lines.

Furthermore, the second switching transistors may be disposed in a one-to-one correspondence with the pixels.

With this configuration, the image display apparatus according to an aspect of the present invention can enhance the effect of curbing crosstalk.

Furthermore, the number of the second switching transistors may be smaller than the number of the pixels.

With this configuration, the image display apparatus according to an aspect of the present invention can curb an increase in circuit area resulting from the provision of the second switching transistors.

Furthermore, it is possible that the pixels include: a red pixel which emits red light; a green pixel which emits green light; and a blue pixel which emits blue light, and the second switching transistors are disposed in units of the pixels, each of the units including the red pixel, the green pixel, and the blue pixel.

With this configuration, the image display apparatus according to an aspect of the present invention can curb an increase in circuit area resulting from the provision of the second switching transistors, without significantly reducing the effect of curbing crosstalk.

Furthermore, the second switching transistors may be disposed in a staggered manner.

With this configuration, the image display apparatus according to an aspect of the present invention can curb an increase in circuit area resulting from the provision of the second switching transistors, without curbing a reduction in the effect of curbing crosstalk.

Furthermore, it is possible that the third power line is composed of third power line portions disposed in the respective columns, and the other of the source terminal and the drain terminal of each of the second switching transistors is connected to one of the third power line portions that is disposed in a corresponding one of the rows.

With this configuration, the image display apparatus according to an aspect of the present invention can effectively curb crosstalk.

Furthermore, the third power line forms a grid.

With this configuration, the image display apparatus according to an aspect of the present invention can reduce a total resistance value of the third power lines.

Furthermore, the third power line forms a plane which covers the pixels.

With this configuration, the image display apparatus according to an aspect of the present invention can further reduce a total resistance value of the third power lines.

Furthermore, it is possible that third power line is composed of third power line portions disposed in the respective rows, and wiring resistance of each of the third power line portions is smaller than wiring resistance of each of the first power lines.

As can be seen from the above, the present invention can provide an image display apparatus capable of curbing crosstalk.

Further Information about Technical Background to this Application

The disclosure of Japanese Patent Application No. 2009-125629 filed on May 25, 2009 including specification, drawings and claims is incorporated herein by reference in its entirety.

The disclosure of PCT application No. PCT/JP2010/003493 filed on May 25, 2010, including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENTS

With reference to the drawings, an embodiment of an image display apparatus according to the present invention will be described in detail below.

An image display apparatus 200 according to the embodiment of the present invention includes a third power line which is connected via a second switching transistor to each of a plurality of first power lines provided for respective rows. With this configuration, the image display apparatus 200 according to the embodiment of the present invention can reduce a difference in voltage drop between adjacent ones of the first power lines by turning on the second switching transistors. This allows curbing of crosstalk.

The image display apparatus 200 according to the embodiment of the present invention can apply different voltages to the plurality of first power lines by turning off the second switching transistors. With this configuration, the image display apparatus 200 according to the embodiment of the present invention can perform control using the first power lines with different timing for each row.

A configuration of the image display apparatus 200 according to the embodiment of the present invention will be described first.

Figure 1A:
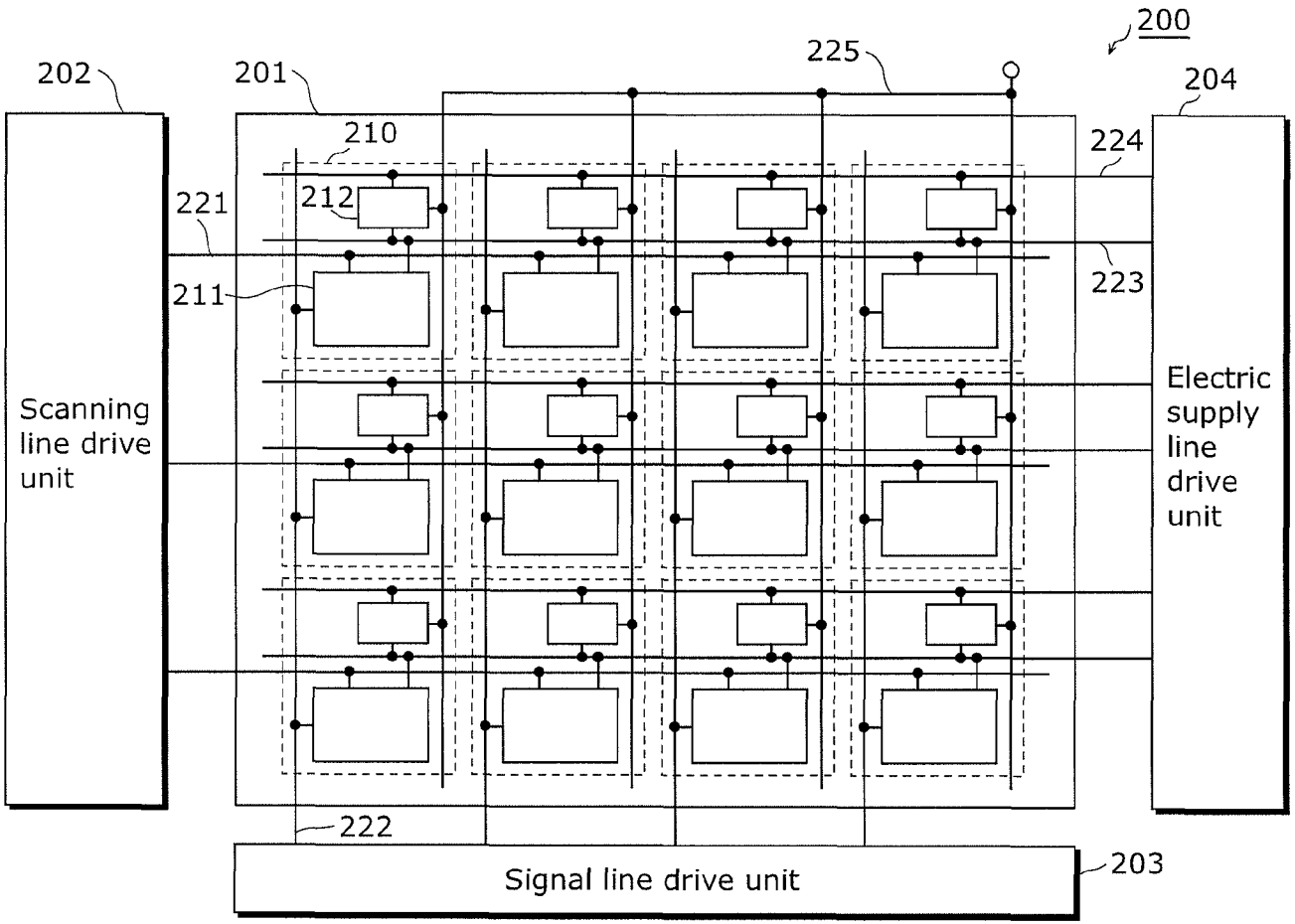
FIG. 1A is a block diagram showing a configuration of an image display apparatus according to an embodiment of the present invention.

FIG. 1A is a block diagram showing a configuration of the image display apparatus 200 according to the embodiment of the present invention.

The image display apparatus 200 shown in FIG. 1A is, for example, an active matrix organic EL display apparatus using an organic EL element and includes a pixel array 201, a scanning line drive unit 202, a signal line drive unit 203, an electric supply line drive unit 204, a plurality of signal lines 222, a plurality of scanning lines 221, a plurality of first power lines 223, a plurality of control lines 224, and a plurality of third power lines 225.

The signal line 222 is disposed along a column direction (a vertical direction of FIG. 1A) for each column.

The scanning line 221, the first power line 223, and the control line 224 are disposed along a row direction (a horizontal direction of FIG. 1A) for each row.

The third power line 225 is disposed along the column direction for each column. The third power lines 225 are used to connect the plurality of first power lines 223 disposed along the row direction to each other in the column direction.

More specifically, a plurality of switching circuits 212 are provided at intersections of the plurality of third power lines 225 disposed for the respective columns and the plurality of first power lines 223 disposed for the respective rows. When each switching circuit 212 is turned on, the corresponding first power line 223 and the corresponding third power line 225 are electrically connected at the intersection.

That is, when all of the switching circuits 212 disposed in one of the columns are turned on, all the first power lines 223 are electrically connected via the third power lines 225 disposed in the column. When all the switching circuits 212 are turned on, all the first power line 223 are electrically connected via all the third power lines 225. In this case, the image display apparatus 200 has the same configuration as a configuration with power lines disposed in a grid.

As described above, in the image display apparatus 200 according to the embodiment of the present invention, the plurality of first power lines 223 provided for the respective rows can be connected to each other via the third power lines 225 by turning on the switching circuits 212. With this configuration, the image display apparatus 200 can reduce a difference in voltage drop between power lines which are independently disposed for respective rows. That is, the image display apparatus 200 can reduce a difference in voltage drop between adjacent ones of the first power lines 223 and can thus curb crosstalk.

A total resistance value of the power lines can be reduced by connecting the plurality of first power lines 223 provided for the respective rows to each other via the third power lines 225. The image display apparatus 200 can thus have smaller voltage drops in the power lines than those in a case where power lines are independently disposed for respective rows. That is, in the image display apparatus 200, power supply voltages to be supplied to pixels can be made uniform.

A reduction in power supply voltage can be more effectively curbed by supplying a power supply voltage $V_{DD}$ from both of the third power lines 225 and the electric supply line drive unit 204 to the first power lines 223.

By turning off all of the switching circuits 212 disposed in one of the rows, the first power line 223 disposed in the row can be made independent of the plurality of first power lines 223 disposed in the other rows. With this configuration, the image display apparatus 200 can apply a reset voltage $V_{RESET}$ which is different from the power supply voltage $V_{DD}$ only to the first power line 223 disposed in a desired one of the rows. The image display apparatus 200 can thus implement control that applies the reset voltage $V_{RESET}$ with different timing for each row.

The pixel array 201 includes a plurality of pixels 210 two-dimensionally disposed in a matrix. Note that although FIG. 1A shows an example in which the pixels 210 in three rows and four columns are disposed in the pixel array 201, the number, the number of rows, and the number of columns of the pixels 210 are not limited to those in the example.

Each pixel 210 includes a pixel circuit 211 and the switching circuit 212.

The pixel circuit 211 holds a signal voltage applied to the signal line 222 disposed in the corresponding column and generates photons with a luminance value corresponding to the held signal voltage.

The switching circuit 212 electrically connects or disconnects the first power line 223 disposed in the corresponding row and the third power line 225 disposed in the corresponding column to or from each other (is turned on or off) in accordance with a control signal applied to the control line 224 disposed in the corresponding row.

The scanning line drive unit 202, the signal line drive unit 203, and the electric supply line drive unit 204 drive the plurality of pixels 210.

More specifically, the scanning line drive unit 202 sequentially selects the plurality of pixels 210, one row at a time, by outputting a scanning signal to the plurality of scanning lines 221.

The signal line drive unit 203 outputs a signal voltage and a reference signal to each of the plurality of signal lines 222. Accordingly, a signal voltage or a reference signal outputted to each of the plurality of signal lines 222 is held in a corresponding one of the plurality of pixels 210 in one of the rows selected by the scanning line drive unit 202.

The electric supply line drive unit 204 selectively outputs the power supply voltage $V_{DD}$ and the reset voltage $V_{RESET}$ to each of the plurality of first power lines 223. The electric supply line drive unit 204 controls the plurality of switching circuits 212 in units of rows by outputting a control signal to each of the plurality of control lines 224.

More specifically, the electric supply line drive unit 204 supplies the power supply voltage $V_{DD}$ to the first power line 223 disposed in one of the rows while the switching circuit 212 disposed in the row is on. The electric supply line drive unit 204 supplies the reset voltage $V_{RESET}$ to the first power line 223 disposed in one of the rows while the switching circuit 212 disposed in the row is off.

The third power lines 225 are supplied with the power supply voltage $V_{DD}$. Note that the power supply voltage $V_{DD}$ may be supplied to the third power lines 225 by a constant voltage source (not shown) of the image display apparatus 200 or the power supply voltage $V_{DD}$ applied from outside the image display apparatus 200 may be directly supplied to a power supply voltage input terminal of the image display apparatus 200.

Figure 1B:
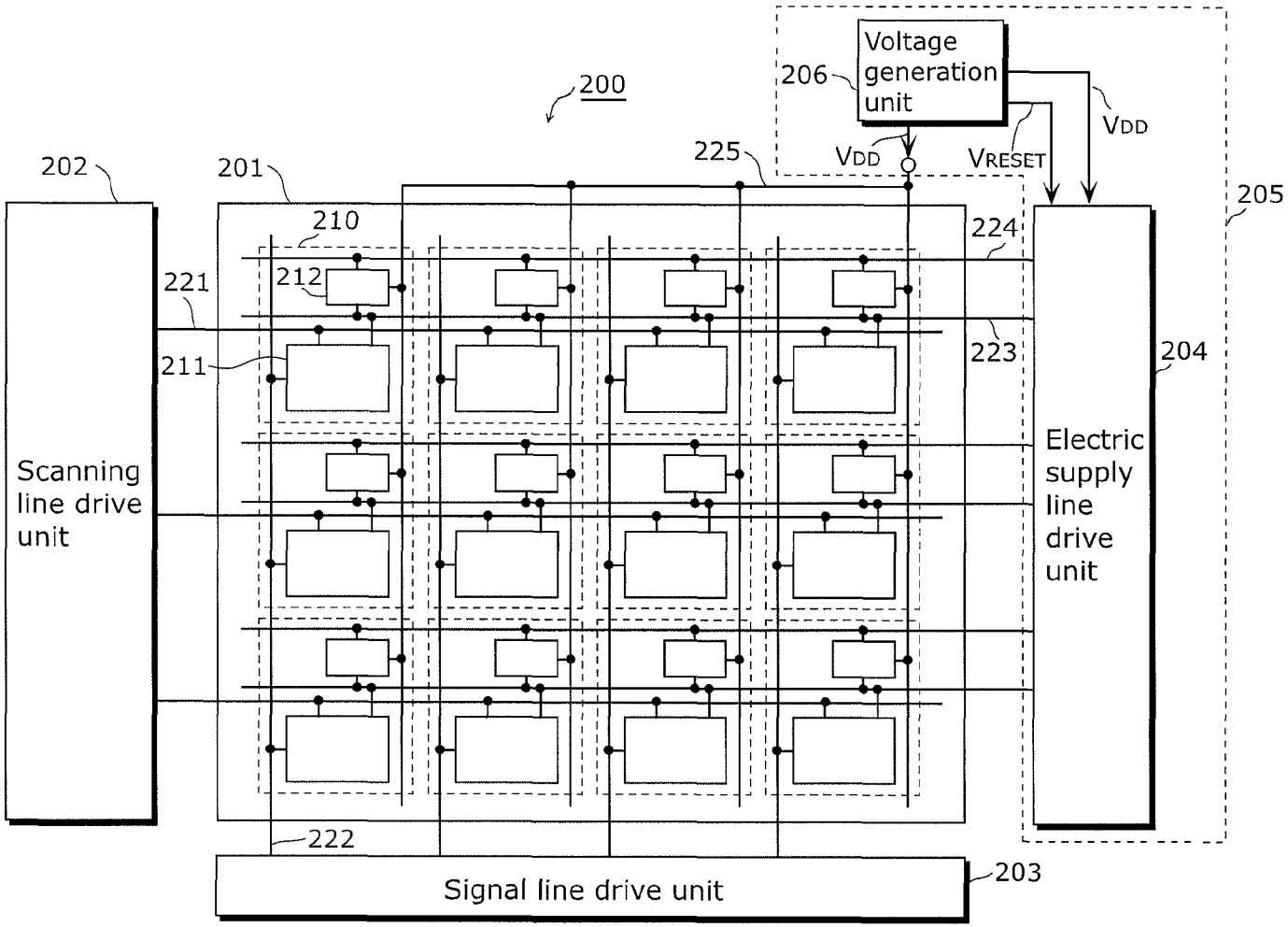
FIG. 1B is a block diagram showing a configuration of an image display apparatus according to an embodiment of the present invention.

FIG. 1B is a block diagram showing a configuration of the image display apparatus 200 including a voltage generation unit 206.

The voltage generation unit 206 shown in FIG. 1B generates the power supply voltage $V_{DD}$ and the reset voltage $V_{RESET}$. The voltage generation unit 206 outputs the generated power supply voltage $V_{DD}$ and reset voltage $V_{RESET}$ to the electric supply line drive unit 204 and supplies the power supply voltage $V_{DD}$ to the third power lines 225.

More specifically, the voltage generation unit 206 has first to third output terminals. The first terminal and second terminal are connected to the electric supply line drive unit 204. The third terminal is connected to the third power lines 225.

The voltage generation unit 206 outputs the power supply voltage $V_{DD}$ to the first output terminal and third output terminal before the switching circuits 212 are turned on. The electric supply line drive unit 204 turns on each switching circuit 212 while the voltage generation unit 206 outputs the power supply voltage $V_{DD}$ to the first output terminal and third output terminal. With this configuration, the same voltage is supplied to the first power line 223 and third power line 225.

The voltage generation unit 206 outputs the reset voltage $V_{RESET}$ to the second output terminal.

The voltage generation unit 206 and the electric supply line drive unit 204 constitute a power supply unit 205. The power supply unit 205 supplies the same voltage to the first power line 223 and the third power line 225 when each switching circuit 212 is turned on.

Although FIG. 1A shows an example in which the plurality of third power lines 225 disposed for the respective columns are connected to each other, the plurality of third power lines 225 disposed for the respective columns may not be connected to each other, and the power supply voltage $V_{DD}$ may be separately supplied to the plurality of third power lines 225.

A configuration of each pixel 210 will be described in detail.

Note that one of the pixels 210 will be described below and that the signal line 222 disposed in the row corresponding to the pixel 210 will be simply referred to as the signal line 222, and the scanning line 221, the first power line 223, the control line 224, and the third power line 225 disposed in the row corresponding to the pixel 210 will be simply referred to as the scanning line 221, the first power line 223, the control line 224, and the third power line 225, respectively.

Figure 2:
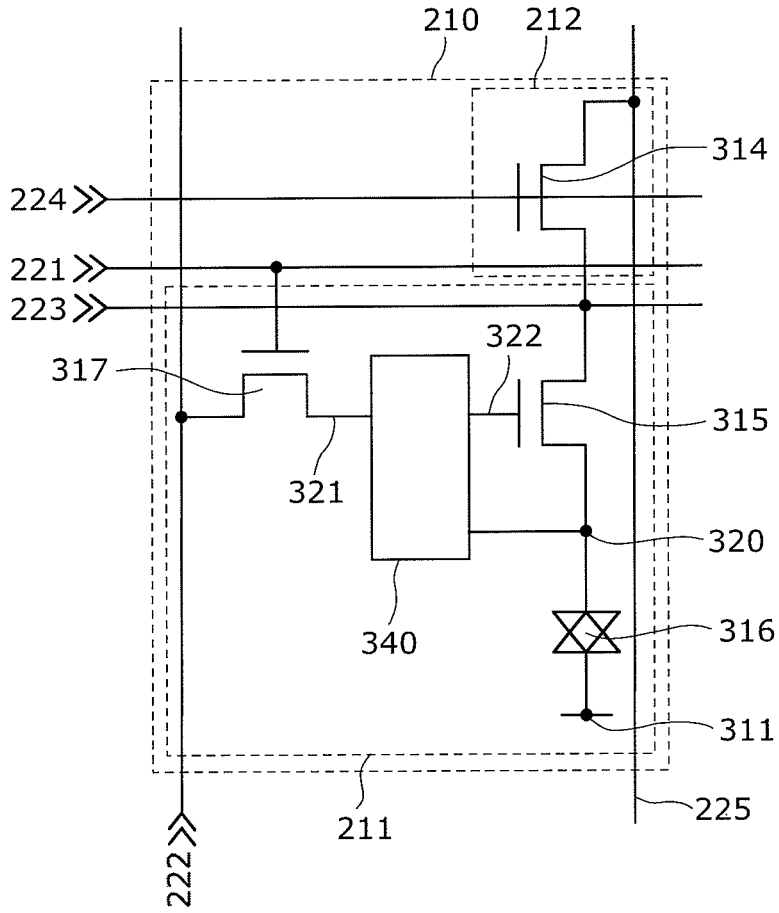
FIG. 2 shows a configuration of a pixel according to an embodiment of the present invention.

FIG. 2 shows a circuit configuration of the one pixel 210.

As shown in FIG. 2, the pixel circuit 211 includes a second power line 311, a drive transistor 315, a luminescence element 316, a first switching transistor 317, and a threshold voltage compensation circuit 340. The switching circuit 212 includes a second switching transistor 314.

The luminescence element 316 is, for example, an organic EL element. The luminescence element 316 has a first terminal and a second terminal, the first terminal is connected to the second power line, and the second terminal is connected to a node 320. The luminescence element 316 generates photons with luminance corresponding to a value of a current flowing between the first terminal and the second terminal.

For example, a ground potential is applied to the second power line 311.

The first switching transistor 317, the second switching transistor 314, and the drive transistor 315 are, for example, n-type thin film transistors (n-type TFTs).

In the first switching transistor 317, a gate terminal is connected to the scanning line 221, one of a source terminal and a drain terminal is connected to the signal line 222, and the other of the source terminal and the drain terminal is connected to a node 321.

In the drive transistor 315, a gate terminal is connected to a node 322, one of a source terminal and a drain terminal is connected to the first power line 223, and the other of the source terminal and the drain terminal is connected to the node 320. The drive transistor 315 converts a voltage applied between the gate terminal and the source terminal (hereinafter referred to as a gate-to-source voltage) into a drive current that is a source-drain current. The drive current is supplied to the luminescence element 316.

In the second switching transistor 314, a gate terminal is connected to the control line 224, one of a source terminal and a drain terminal is connected to the first power line 223, and the other of the source terminal and the drain terminal is connected to the third power line 225.

The threshold voltage compensation circuit 340 has at least a first terminal, a second terminal, and a third terminal. The first terminal is connected to the node 321, the second terminal is connected to the node 322, and the third terminal is connected to the node 320. The threshold voltage compensation circuit 340 is a circuit for compensating for variation in transistor characteristics such as a threshold voltage of the drive transistors 315. More specifically, the threshold voltage compensation circuit 340 detects a voltage corresponding to a threshold voltage of the drive transistor 315. The threshold voltage compensation circuit 340 performs control such that a difference in voltage between the second terminal and the third terminal is the sum of the detected voltage and a voltage corresponding to a signal inputted to the first terminal. The threshold voltage compensation circuit 340 also performs control such that the gate-to-source voltage of the drive transistor 315 does not change while the first switching transistor 317 is off.

Figure 3:
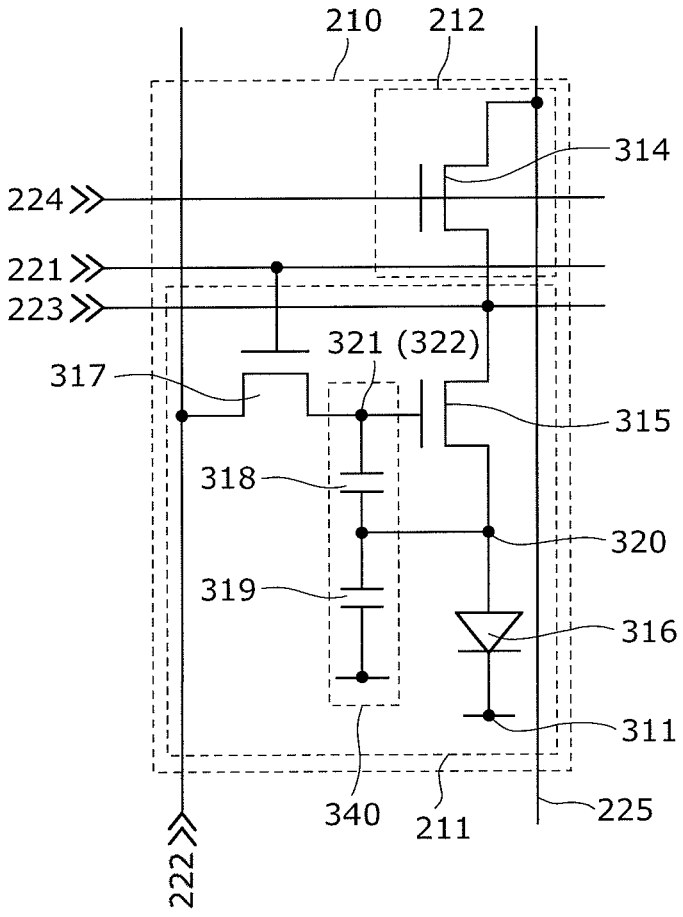
FIG. 3 shows a configuration of a pixel according to an embodiment of the present invention.

FIG. 3 shows a detailed configuration of the pixel 210.

As shown in FIG. 3, for example, the luminescence element 316 has a cathode connected to the second power line 311 and an anode connected to the node 320.

The threshold voltage compensation circuit 340 includes capacitive elements 318 and 319.

The capacitive element 318 is connected between the node 320 and the node 321 (322). The capacitive element 318 holds electric charge corresponding to a signal voltage supplied from the signal line 222 via the first switching transistor 317. The capacitive element 318 has a function of keeping the gate-to-source voltage of the drive transistor 315 constant after the first switching transistor 317 is turned off.

The capacitive element 319 is connected between the node 320 and the second power line 311. The capacitive element 319 has a function of causing, together with the capacitive element 318 and the luminescence element 316, the capacitive element 318 to hold a desired voltage which corresponds to a capacitance ratio between the capacitive element 318 and the capacitive element 319 and corresponds to a potential difference between a reference voltage and a signal voltage supplied from the signal line 222.

Note that a circuit configuration of the threshold voltage compensation circuit 340 is not limited to the circuit configuration shown in FIG. 3 and may be any other configuration as long as it has the same or like functions. The capacitive element 319 may be a parasitic capacitance of the luminescence element 316.

With the above-described configuration, the image display apparatus 200 according to the embodiment of the present invention can connect the plurality of first power lines 223 provided for the respective rows to each other by turning on the second switching transistors 314. This allows the image display apparatus 200 to reduce a difference in voltage drop between adjacent ones of the first power lines 223, which can curb crosstalk. Furthermore, the image display apparatus 200 can apply the power supply voltage $V_{DD}$ and the reset voltage $V_{RESET}$ to the plurality of first power lines 223 by turning off the second switching transistors 314. With this configuration, the image display apparatus 200 can implement control that applies the reset voltage $V_{RESET}$ with different timing for each row.

An operation of the image display apparatus 200 according to the embodiment of the present invention will be described.

Figure 4:
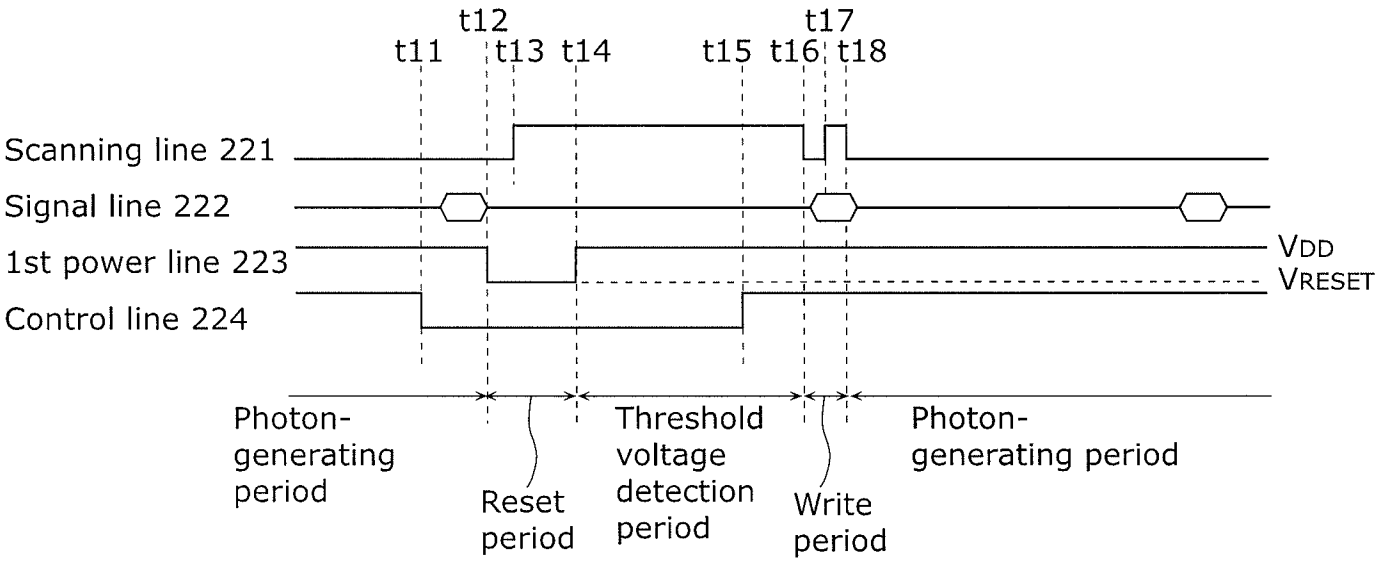
FIG. 4 is a timing chart showing displaying operation of an image display apparatus according to an embodiment of the present invention.

FIG. 4 is a timing chart for the image display apparatus 200. FIG. 4 shows an operation of each pixel 210 disposed in one of the rows during one horizontal period.

Before time t11 shown in FIG. 4, the luminescence element 316 generates photons corresponding to a signal voltage in an immediately preceding horizontal period.

More specifically, the power supply voltage $V_{DD}$ is supplied to the first power line 223, and the drive transistor 315 supplies a drive current corresponding to the signal voltage to the luminescence element 316. Since the second switching transistor 314 is on, the first power line 223 and the third power line 225 are connected. Accordingly, the power supply voltage $V_{DD}$ is supplied from both of the electric supply line drive unit 204 and the third power line 225 to the first power line 223.

At time t11, the electric supply line drive unit 204 changes a control signal to be supplied to the control line 224 from High (H) level (active) to Low (L) level (non-active). This turns off the second switching transistor 314. Note that although the power supply voltage $V_{DD}$ is not supplied from the third power line 225 to the first power line 223 from time t11 to time t12, since the power supply voltage $V_{DD}$ is supplied from the electric supply line drive unit 204 to the first power line 223, the luminescence element 316 generates photons corresponding to the signal voltage in the immediately preceding horizontal period, like before time t11.

At time t12, the electric supply line drive unit 204 changes a voltage to be supplied by the first power line 223 from the power supply voltage $V_{DD}$ (e.g., 10 V) to the reset voltage $V_{RESET}$. With this operation, a source potential (at the node 320) of the drive transistor 315 shifts to a potential close to the reset voltage $V_{RESET}$.

Note that a period from t11 to t12 is a period provided to prevent the power supply voltage $V_{DD}$ supplied from the third power line 225 and the reset voltage $V_{RESET}$ supplied from the electric supply line drive unit 204 from colliding with each other. That is, the electric supply line drive unit 204 may change the control signal to be supplied to the control line 224 from H level to L level at or before time t12. Note that since the second switching transistor 314 is on, and the power supply voltage $V_{DD}$ can be supplied from both of the third power line 225 and the electric supply line drive unit 204 to the first power line 223, it is preferable that a period during which the second switching transistor 314 is on is as long as possible. That is, it is preferable that the period from t11 to t12 is a minimum period that can guarantee to prevent collision between the power supply voltage $V_{DD}$ and the reset voltage $V_{RESET}$.

At time t13, the scanning line drive unit 202 changes a scanning signal to be supplied to the scanning line 221 from L level to H level. At this time, the signal line drive unit 203 is supplying a reference voltage Vo (e.g., 0 V) to the signal line 222. This turns on the first switching transistor 317 and resets a gate potential (at the node 321) of the drive transistor 315 to the reference voltage Vo. Simultaneously, the source potential of the drive transistor 315 is fixed to the reset voltage $V_{RESET}$.

As described above, during a reset period from t12 to t14, the image display apparatus 200 performs a reset operation of setting the gate potential of the drive transistor to the reference voltage Vo and initializes the source potential of the drive transistor 315 to the reset voltage $V_{RESET}$ (e.g., −10 V) sufficiently lower than the reference voltage Vo (e.g., 0 V).

The reset voltage $V_{RESET}$ is a voltage lower than the reference voltage Vo by a threshold voltage Vth of the drive transistor 315 or more.

At time t14, the electric supply line drive unit 204 changes the voltage to be supplied by the first power line 223 from the reset voltage $V_{RESET}$ to the power supply voltage $V_{DD}$.

The gate-to-source voltage of the drive transistor 315 is $Vo-V_{RESET}$. Since the reset voltage $V_{RESET}$ is a voltage lower than the reference voltage Vo by the threshold voltage Vth of the drive transistor 315 or more as described above, the gate-to-source voltage of the drive transistor 315 is higher than the threshold voltage Vth of the drive transistor 315. Accordingly, when the drive transistor 315 is turned on, a current flows through the drive transistor 315, which raises the source potential of the drive transistor 315. The rise in source potential causes the gate-to-source voltage of the drive transistor 315 to start decreasing. When the gate-to-source voltage reaches the threshold voltage Vth of the drive transistor 315, the drive transistor 315 is turned off, which fixes the source potential. That is, during a threshold voltage detection period from t14 to t16, the source potential changes to Vo−Vth. The potential of Vo−Vth is held in the capacitive element 319.

As described above, during the threshold voltage detection period from t14 to t16, the image display apparatus 200 performs a threshold voltage detection operation of changing the gate-to-source voltage of the drive transistor 315 to a voltage corresponding to the threshold voltage of the drive transistor 315.

At time t15, the electric supply line drive unit 204 changes the control signal to be supplied to the control line 224 from L level to H level. This turns on the second switching transistor 314 and connects the first power line 223 and third power line 225. Accordingly, the power supply voltage $V_{DD}$ is supplied from both of the electric supply line drive unit 204 and the third power line 225 to the first power line 223.

Note that a period from t14 to t15 is a period provided to prevent the power supply voltage $V_{DD}$ supplied from the third power line 225 and the reset voltage $V_{RESET}$ supplied from the electric supply line drive unit 204 from colliding with each other. That is, the electric supply line drive unit 204 may change the control signal to be supplied to the control line 224 from L level to H level at or after time t14. Since no photons are generated during the threshold voltage detection period (the period from t14 to t15), a displayed image is not affected even when the first power line 223 is supplied with the power supply voltage $V_{DD}$ only from the electric supply line drive unit 204. It is thus preferable that the control signal to be supplied to the control line 224 be changed from L level to H level between a time later than time t14 by a minimum time that can guarantee to prevent collision between the power supply voltage $V_{DD}$ and the reset voltage $V_{RESET}$ and time t17 at which generation of photons is started.

At time t16, the scanning line drive unit 202 changes the scanning signal to be supplied to the scanning line 221 from H level to L level. This turns off the first switching transistor 317. Next, the signal line drive unit 203 supplies a signal voltage Vin to the signal line 222.

At time t17, the scanning line drive unit 202 changes the scanning signal to be supplied to the scanning line 221 from L level to H level. This turns on the first switching transistor 317, and the signal voltage Vin supplied to the signal line 222 is written to the pixel circuit 211.

More specifically, the gate potential of the drive transistor 315 becomes the signal voltage Vin. Since the luminescence element 316 is in a cutoff state (high impedance state) at first, a drain-to-source current of the drive transistor 315 flows into the capacitive element 319. This raises the source potential of the drive transistor 315 to Vth−ΔV. That is, the gate-to-source voltage of the drive transistor 315 becomes Vin+Vth−ΔV.

The drain-to-source current of the drive transistor 315 increases with a rise in the signal voltage Vin, which increases an absolute value of ΔV. Accordingly, mobility correction corresponding to a photon luminance level is performed. When the signal voltage Vin is kept constant, since the absolute value of ΔV increases with an increase in the mobility of the drive transistor 315, variation in mobility of the drive transistors 315 can be eliminated.

As described above, during a write period from t16 to t18, the image display apparatus 200 performs a write operation of setting the gate-to-source voltage of the drive transistor 315 to the sum of the signal voltage Vin and the voltage corresponding to the threshold voltage Vth and writing the sum to the capacitive element 318. At this time, the voltage ΔV for mobility correction is subtracted from the voltage held in the capacitive element 318. In the above-described manner, correction of the threshold voltage and mobility of the drive transistor 315 is performed simultaneously with writing of the signal voltage Vin.

At time t18, the scanning line drive unit 202 changes the scanning signal to be supplied to the scanning line 221 from H level to L level. This turns off the first switching transistor 317. At or after time t18, a drive current corresponding to the gate-to-source voltage (Vin+Vth−ΔV) of the drive transistor 315 flows into the luminescence element 316. With the drive current, the luminescence element 316 generates photons corresponding to the signal voltage Vin. Note that, to be exact, as soon as the gate-to-source voltage of the drive transistor 315 becomes (Vin+Vth−ΔV) after time t17 and before time t18, the luminescence element 316 starts generating photons corresponding to the signal voltage Vin.

Even when the source potential of the drive transistor varies during a photon-generating period (at or after time t18), the gate-to-source voltage (Vin+Vth−ΔV) of the drive transistor 315 is kept constant by the capacitive element 318.

As described above, the image display apparatus 200 according to the embodiment of the present invention performs a reset operation before a threshold voltage detection operation by supplying the power supply voltage $V_{DD}$ and reset voltage $V_{RESET}$ to the first power lines 223. With this configuration, the image display apparatus 200 can implement a threshold voltage correction operation while curbing an increase in circuit scale.

Note that the above-described control is performed on the plurality of pixels 210 with different timing for each row.

As can be seen from the above, the image display apparatus 200 according to the embodiment of the present invention can connect the plurality of first power lines 223 provided for the respective rows to each other by turning on the second switching transistors 314. This allows the image display apparatus 200 to reduce a difference in voltage drop between adjacent ones of the first power lines 223, which can curb crosstalk.

Additionally, the image display apparatus 200 can apply the power supply voltage $V_{DD}$ and the reset voltage $V_{RESET}$ separately to the plurality of first power lines 223 by turning off the second switching transistors 314. This allows the image display apparatus 200 to perform a reset operation before a threshold voltage detection operation with different timing for each row.

A modification of the above-described image display apparatus 200 will be described below.

In the above description, as shown in FIG. 1A, the image display apparatus 200 includes the switching circuits 212, which correspond one-to-one to the pixel circuits 211. The number of switching circuits 212 of the image display apparatus 200 may be smaller than the number of pixel circuits 211. More specifically, the image display apparatus 200 may include at least one switching circuit 212 for each row.

Note that an increase in the number of switching circuits 212 allows enhancement of the effect of curbing crosstalk. On the other hand, a reduction in the number of switching circuits 212 allows curbing of an increase in a circuit area resulting from provision of the switching circuits 212.

FIGS. 5 to 9 are diagrams showing configurations of image display apparatuses 200A to 200E which are modifications of the image display apparatus 200.

Figure 5:
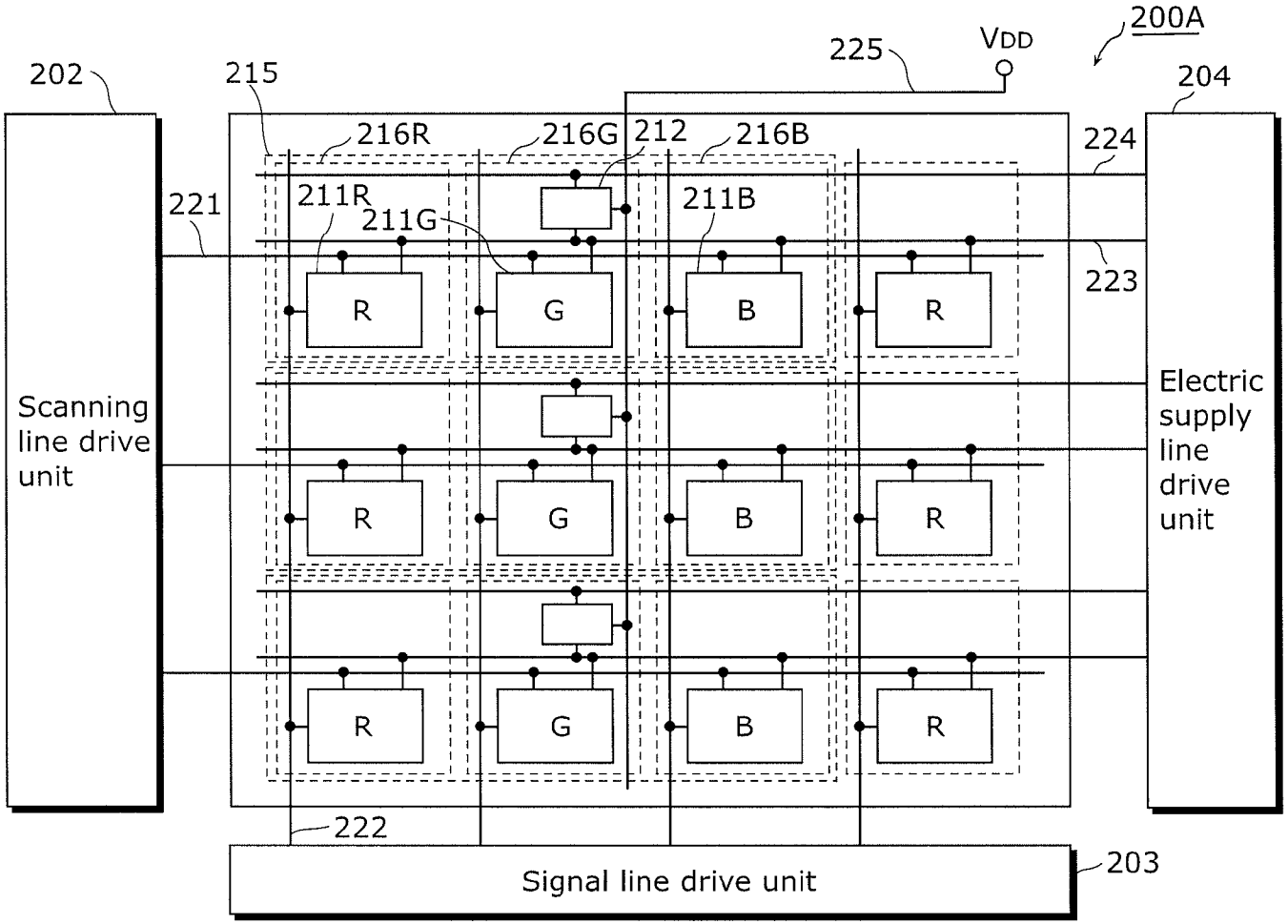
FIG. 5 is a block diagram showing a configuration of an image display apparatus according to a modification of an embodiment of the present invention.

For example, the image display apparatus 200A shown in FIG. 5 includes one switching circuit 212 for each unit pixel 215. The unit pixel 215 includes a red pixel 216R, a green pixel 216G, and a blue pixel 216B. The red pixel 216R includes a red pixel circuit 211R which emits red light. The green pixel 216G includes a green pixel circuit 211G which emits green light. The blue pixel 216B includes a blue pixel circuit 211B which emits blue light.

Even when a power supply voltage $V_{DD}$ varies within each unit pixel 215, a user feels little sense of discomfort. Accordingly, the image display apparatus 200A can curb an increase in circuit area resulting from provision of the second switching transistors, without significantly reducing the effect of curbing crosstalk.

Note that each unit pixel 215 only needs to include at least one red pixel 216R, at least one green pixel 216G, and at least one blue pixel 216B and that the numbers of red pixels 216R, green pixels 216G, and blue pixels 216B included in each unit pixel 215 may be different.

Figure 6:
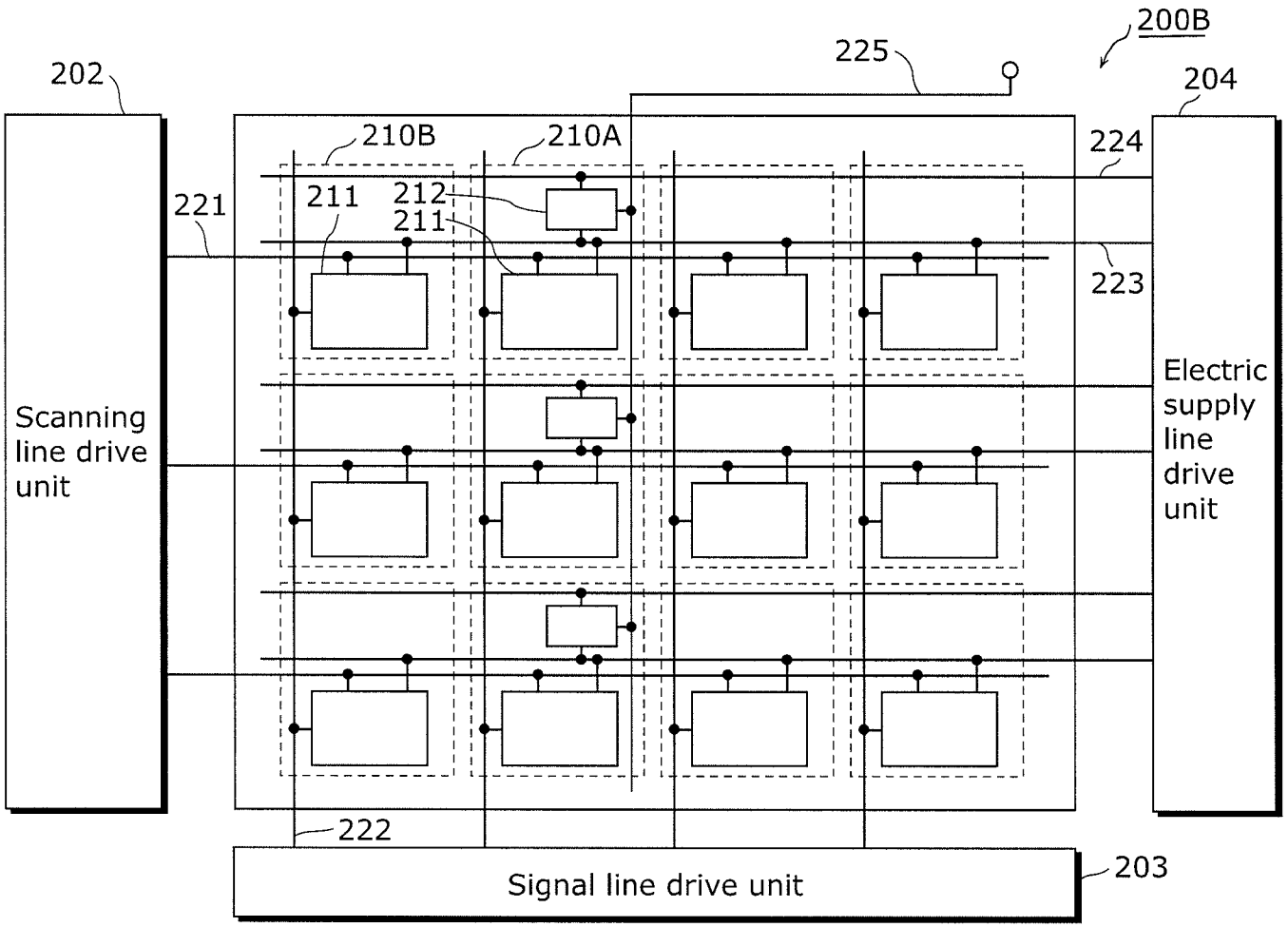
FIG. 6 is a block diagram showing a configuration of an image display apparatus according to a modification of an embodiment of the present invention.

Like the image display apparatus 200B shown in FIG. 6, one switching circuit 212 may be provided for each row. The image display apparatus 200B includes a first pixel 210A which includes the switching circuit 212 and a second pixel 210B which does not include the switching circuit 212. Additionally, the image display apparatus 2008 includes only one third power line 225 which is disposed along a column direction. Even with this configuration, since the plurality of first power lines 223 can be connected via the switching circuits 212 and third power lines 225, crosstalk can be curbed. Note that when the switching circuits 212 and the third power line 225 are disposed only for one column, it is preferable that the switching circuits 212 and the third power line 225 be disposed in a column close to the middle of the pixel array 201 in order to effectively curb crosstalk.

Note that the switching circuits 212 and the third power line 225 may be disposed for each of two or more rows. In this case, it is preferable that sets of the switching circuits 212 and the third power line 225 be equally spaced every predetermined number of columns out of the plurality of columns in order to effectively curb crosstalk.

Figure 7:
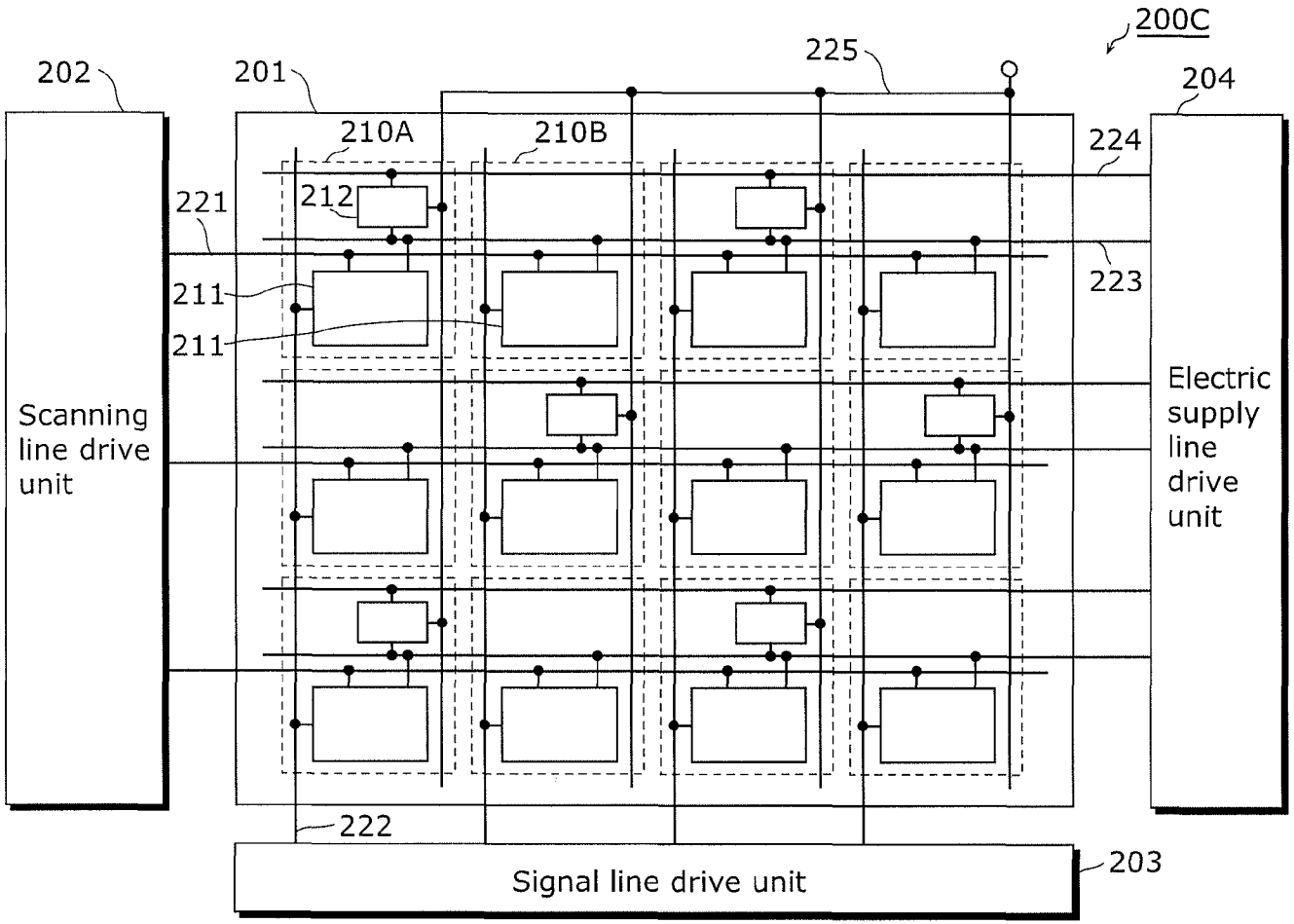
FIG. 7 is a block diagram showing a configuration of an image display apparatus according to a modification of an embodiment of the present invention.

Like the image display apparatus 200C shown in FIG. 7, the switching circuits 212 may be disposed in a staggered manner.

With this configuration, the image display apparatus 200C can curb an increase in circuit area resulting from provision of the switching circuits 212 while suppressing a reduction in the effect of curbing crosstalk.

The third power line 225 may not be disposed along a column direction.

Figure 8:
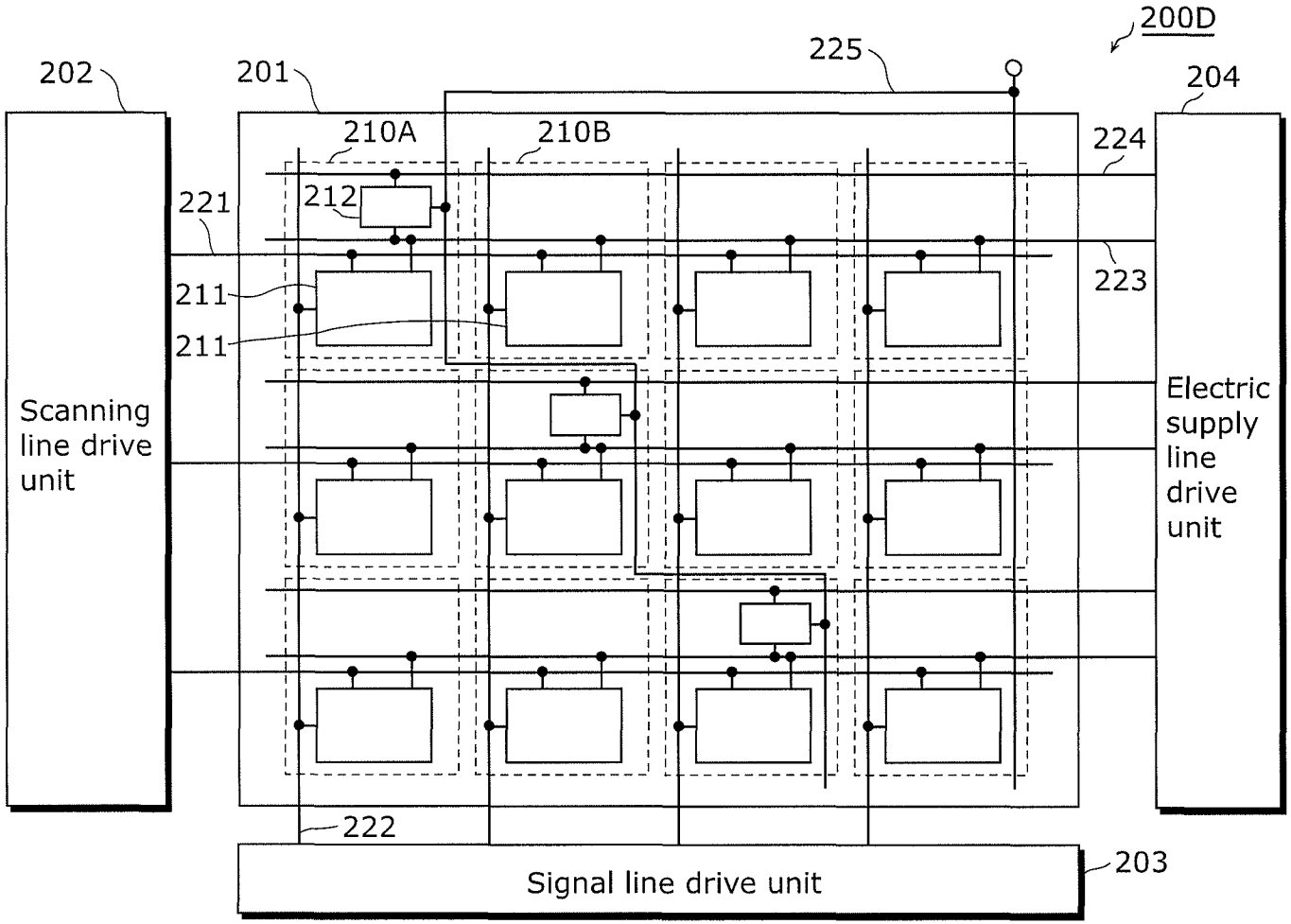
FIG. 8 is a block diagram showing a configuration of an image display apparatus according to a modification of an embodiment of the present invention.

For example, like the image display apparatus 200D shown in FIG. 8, the third power line 225 may be disposed along a diagonal direction.

Figure 9:
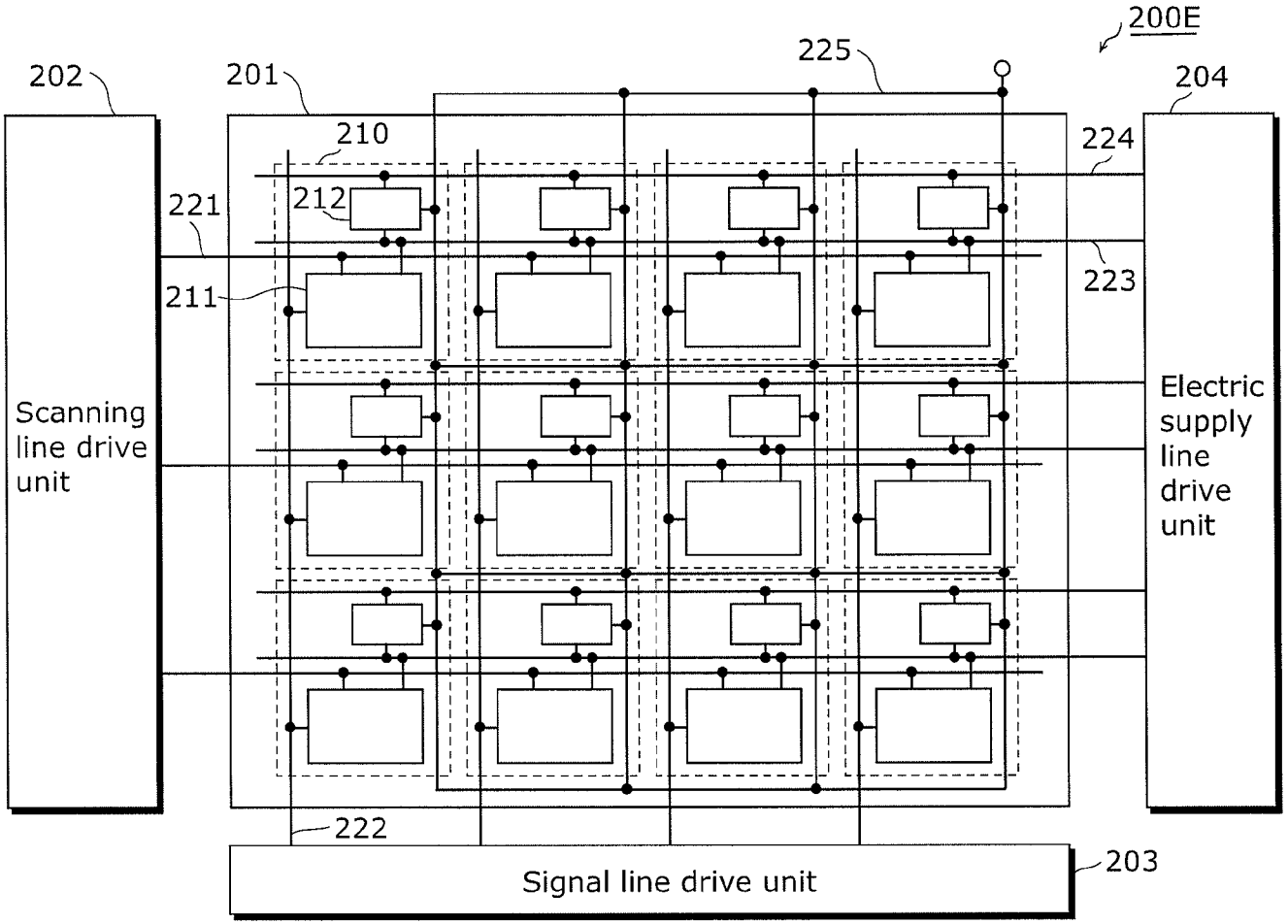
FIG. 9 is a block diagram showing a configuration of an image display apparatus according to a modification of an embodiment of the present invention.

Like the image display apparatus 200E shown in FIG. 9, the plurality of third power lines 225 disposed for the respective columns may be connected to each other by pieces of wiring which are disposed along a row direction. In other words, the third power lines 225 may be disposed in a grid. This configuration allows a reduction in a total resistance value of the third power lines 225.

The third power lines 225 may be formed in a dedicated wiring layer over the pixel array 201. This configuration allows a further reduction in the total resistance value of the third power lines 225.

The third power line 225 may be disposed for each row. In this case, it is preferable that wiring resistance of each third power line 225 be lower than wiring resistance of each first power line 223.

Figure 10:
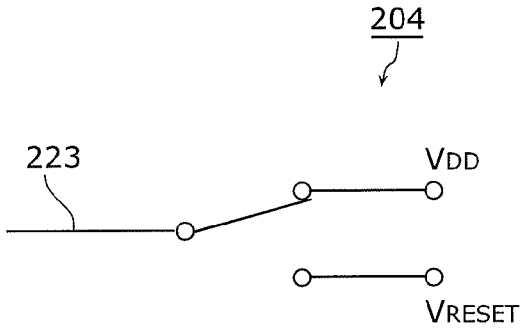
FIG. 10 shows a configuration of an electric supply line drive unit according to an aspect of the present invention.
Figure 11:
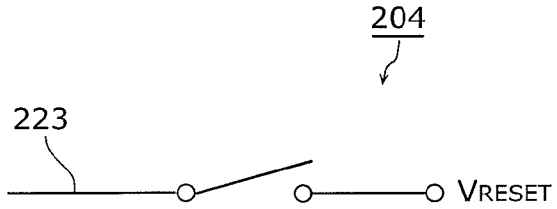
FIG. 11 shows a configuration of an electric supply line drive unit according to a modification of an aspect of the present invention.

FIGS. 10 and 11 are diagrams schematically showing a circuit which drives each first power line 223 included in the electric supply line drive unit 204.

In the above description, the electric supply line drive unit 204 selectively supplies the power supply voltage $V_{DD}$ and the reset voltage $V_{RESET}$ to the first power lines 223 as shown in FIG. 10. It is also possible that the electric supply line drive unit 204 does not supply the power supply voltage $V_{DD}$ to the first power lines 223 as shown in FIG. 11.

More specifically, the electric supply line drive unit 204 shown in FIG. 11 activates each control line 224 and places the first power line 223 disposed in the same row as the control line 224 in a high impedance state (supplies no voltage to the first power line 223). The electric supply line drive unit 204 shown in FIG. 11 deactivates each control line 224 and supplies the reset voltage $V_{RESET}$ to the first power line 223 disposed in the same row as the control line 224. Note that, in this case, the third power lines 225 need to be supplied with the power supply voltage $V_{DD}$.

With this configuration, a circuit configuration of the electric supply line drive unit 204 shown in FIG. 11 can be made simpler than a circuit configuration of the electric supply line drive unit 204 shown in FIG. 10.

The arrangement of the scanning line drive unit 202, the signal line drive unit 203, and the electric supply line drive unit 204 is illustrative only, and the present invention is not limited thereto. For example, both of the scanning line drive unit 202 and the electric supply line drive unit 204 may be disposed in the same direction with respect to the pixel array 201.

In the above description, one electric supply line drive unit 204 drives the first power lines 223 and the control lines 224. it is also possible that the image display apparatus 200 includes a drive unit which drives the first power lines 223 and a drive unit which drives the control lines 224, and the two drive units are disposed such that the pixel array 201 is sandwiched between the drive units.

Note that the image display apparatus according to an implementation of the present invention is not limited to the above-described embodiment. The present invention includes other embodiments that are obtained by combining given constituents in the above embodiment, modifications that are obtained by making various modifications that those skilled in the art could think of, to the present embodiment, within the scope of the present invention, and various devices which incorporate the image display apparatus according to an implementation of the present invention.

For example, the above embodiment has described the first switching transistors 317, the second switching transistors 314, and the drive transistors 315 as n-type transistors. However, some or all of the transistors may be formed of p-type transistors. In this case, polarity and the like of each signal may be changed in accordance with the change in transistor type.

Although the first switching transistors 317, the second switching transistors 314, and the drive transistors 315 have been described as TFTs, other field-effect transistors may be used. The transistors may be bipolar transistors having a base, a collector, and an emitter.

Figure 12:
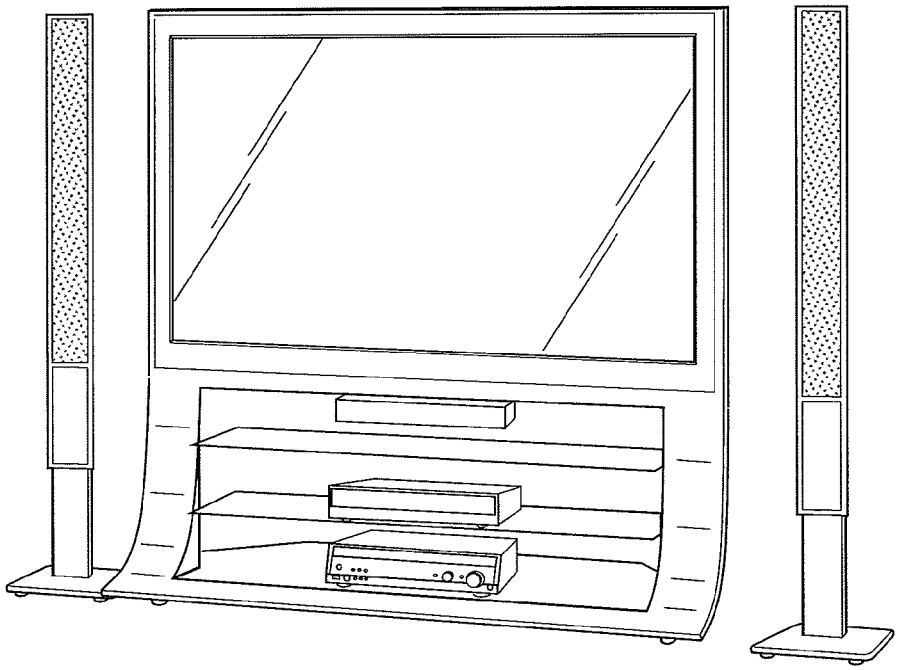
FIG. 12 is an outline view of a thin, flat-panel TV in which an image display apparatus according to an embodiment of the present invention is built.
Figure 13:
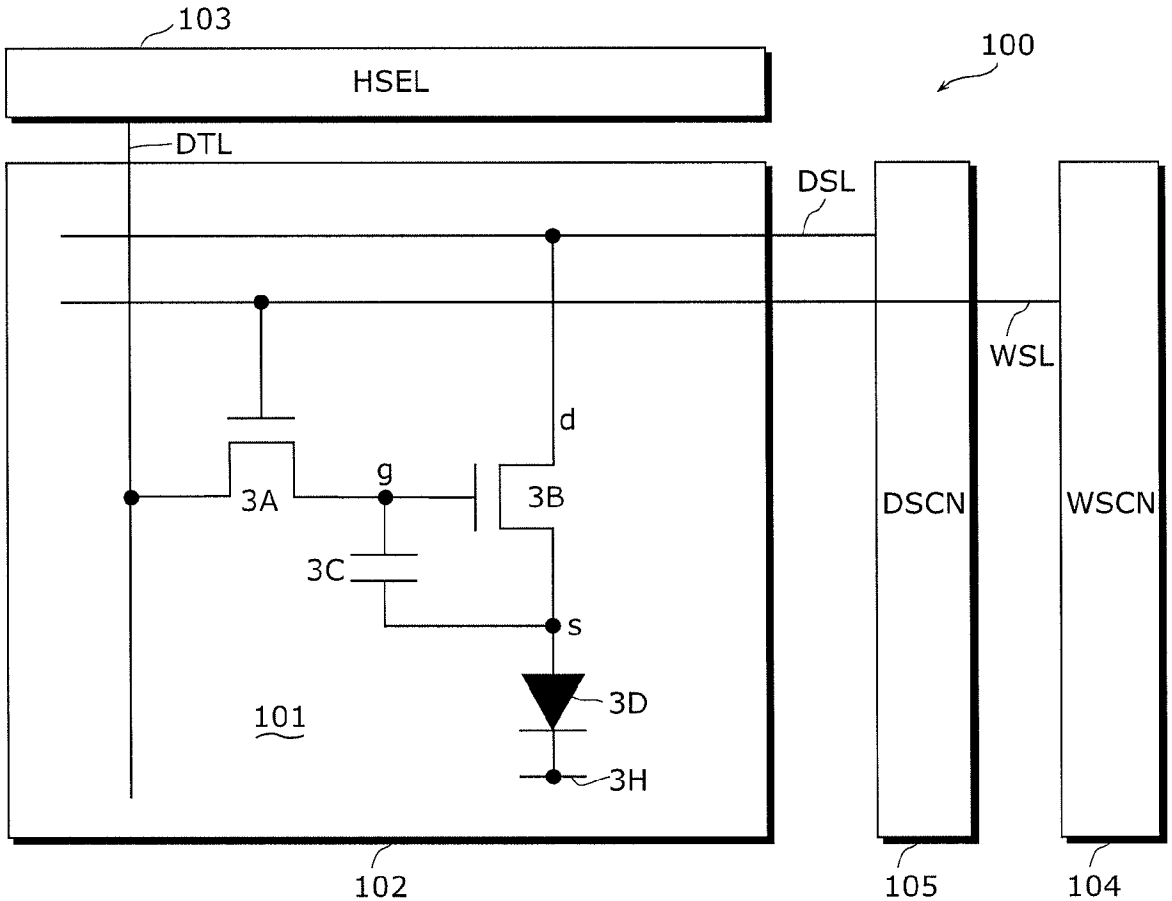
FIG. 13 shows a configuration of a conventional image display apparatus.
Figure 14:
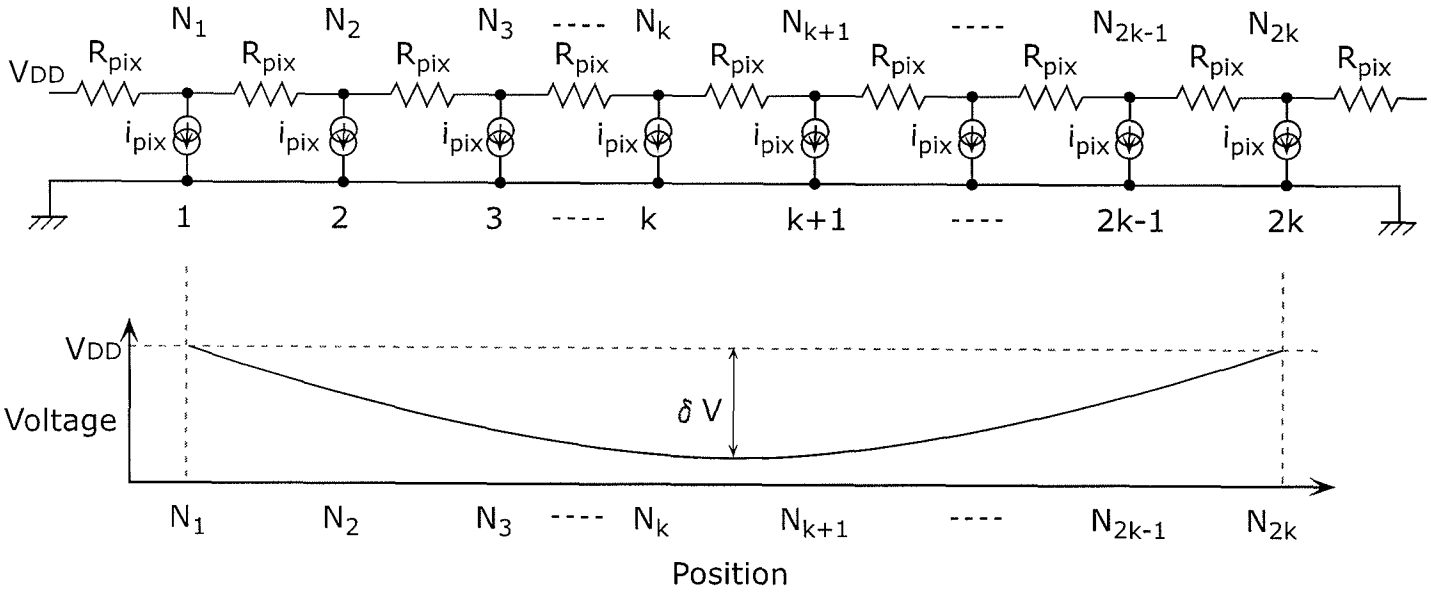
FIG. 14 is a chart showing a drop in power supply voltage.
Figure 15:
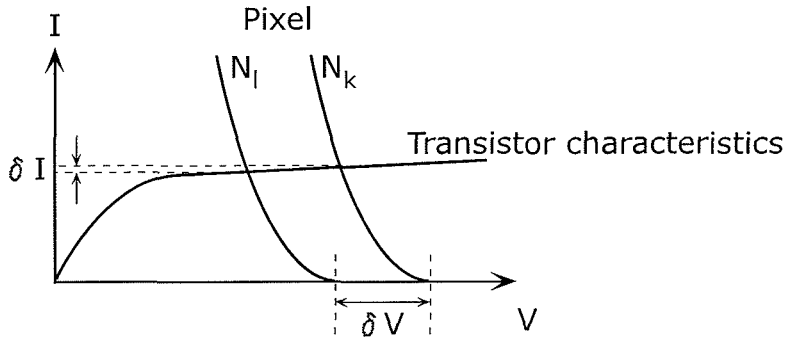
FIG. 15 is a chart showing a relationship between a drop in power supply voltage and a current flowing through a luminescence element.
Figure 16:
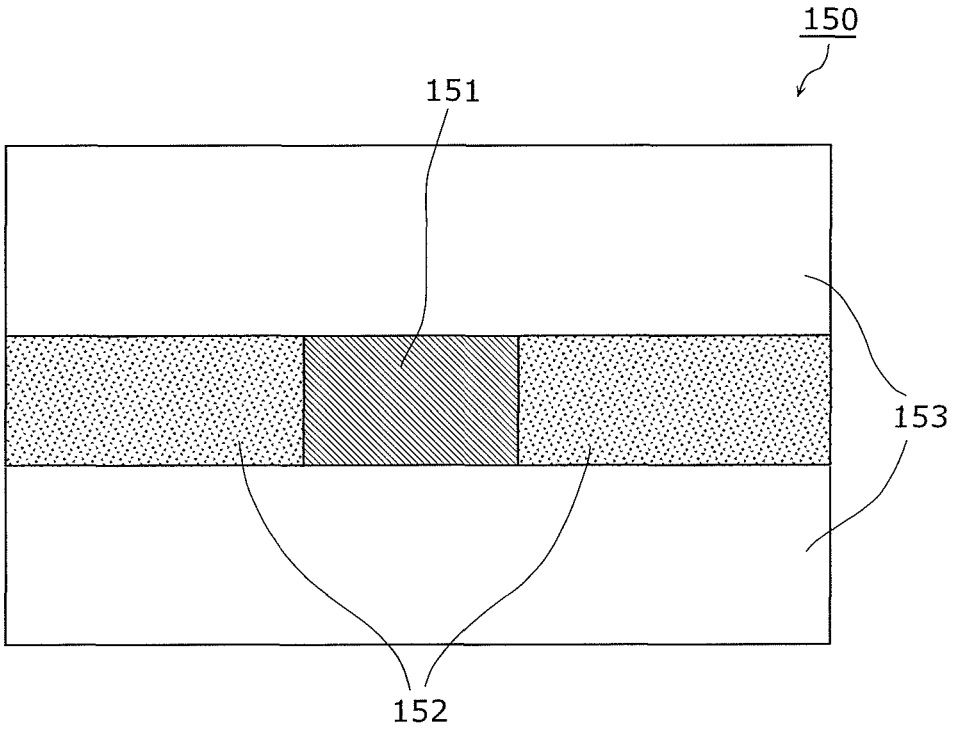
FIG. 16 shows a screen display example when there is a drop in power supply voltage.

For example, the image display apparatus 200 according to an implementation of the present invention is built in a thin, flat-panel TV as illustrated in FIG. 12. Inclusion of the image display apparatus 200 according to an implementation of the present invention provides a thin, flat-panel TV capable of accurate image display with crosstalk curbed.

Furthermore, the image display apparatus 200 according to the above embodiment is typically implemented as one LSI that is an integrated circuit. The processing units included in the image display apparatus 200 may be each provided on a single chip, and part or all of them may be formed into a single chip.

Although an LSI is mentioned in the above, this may be referred to as IC, system LSI, super LSI, or ultra LSI, depending on integration density.

Furthermore, the circuit integration is not limited to the LSI, and part of the processing units included in the image display apparatus 200 may be achieved by a dedicated circuit or a general-purpose processor. A field programmable gate array (FPGA) that is programmable after an LSI is manufactured or a reconfigurable processor that is capable of reconfiguring connection and setting of circuit cells inside an LSI may be used.

Furthermore, part of functions of the drive units included in the image display apparatus 200 according to the embodiment of the present invention may be implemented through execution of a program in a processor such as a CPU. In addition, the present invention may be implemented as a method of driving the image display apparatus, which includes characteristic steps that the above drive units execute.

Furthermore, the present invention may be the above program and may also be a recording medium on which the above program is recorded. It goes without saying that the above program can be distributed via a communication network such as the Internet.

Although the above description shows an example in which the image display apparatus 200 is an active matrix organic EL display apparatus, the present invention is applicable to organic EL display apparatuses of other types than the active matrix type and also applicable to image display apparatuses other than the organic EL display apparatus using a current-driven luminescence element and also applicable to image display apparatuses, such as liquid-crystal display apparatuses, using voltage-driven luminescence elements.

In addition, at least part of configurations of the image display apparatuses according to the above embodiment and modifications thereof may be combined.

Although only an exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention.

INDUSTRIAL APPLICABILITY

The present invention is applicable to an image display apparatus and particularly to an active matrix organic EL display apparatus.

What is claimed is:

1. An image display apparatus comprising a pixel array unit, wherein the pixel array unit includes:

a plurality of pixels disposed in rows and columns;

signal lines disposed in the respective columns;

scanning lines, first power lines, and control lines disposed in the respective rows; and a second power line, each of the pixels includes:

a first switching transistor having a gate terminal, a source terminal, and a drain terminal, the gate terminal being connected to one of the scanning lines that is disposed in a corresponding one of the rows, and one of the source terminal and the drain terminal being connected to one of the signal lines that is disposed in a corresponding one of the columns;

a drive transistor having a gate terminal, a source terminal, and a drain terminal, the gate terminal being electrically connected to the other of the source terminal and the drain terminal of the first switching transistor, and one of the source terminal and the drain terminal being electrically connected to one of the first power lines that is disposed in the corresponding row; and a luminescence element having a first terminal and a second terminal and generating photons according to a value of a current flowing between the first terminal and the second terminal, the first terminal being connected to the second power line, and the second terminal being electrically connected to the other of the source terminal and the drain terminal of the drive transistor, the pixel array unit further includes:

a third power line for use in connecting the first power lines to each other along the columns; and second switching transistors disposed at least one for each of the rows and each having a gate terminal, a source terminal, and a drain terminal, the gate terminal being connected to one of the control lines that is disposed in a corresponding one of the rows, one of the source terminal and the drain terminal being connected to one of the first power lines that is disposed in the corresponding row, and the other of the source terminal and the drain terminal being connected to the third power line, the image display apparatus further comprises a power supply unit configured to supply a same voltage to the first power lines and the third power line when the second switching transistors are turned ON and, and the first power lines are connected to each other via the third power line when the second switching transistors are turned ON.

2. The image display apparatus according to claim 1, wherein each of the pixels further includes a capacitive element connected between the gate terminal of the drive transistor and the other of the source terminal and the drain terminal of the drive transistor.

3. The image display apparatus according to claim 1, wherein the power supply unit is configured to supply a first voltage to the third power line and includes an electric supply line drive unit configured to (i) supply the first voltage to one of the first power lines that is disposed in one of the rows in which one of the control lines is disposed, before a corresponding one of the second switching transistors is turned ON to activate the control line and (ii) supply a second voltage to the first power line disposed in the row in which the control line is disposed, after the second switching transistor is turned OFF to deactivate the control line, the second voltage being different from the first voltage.

4. The image display apparatus according to claim 3, wherein the power supply unit further includes a voltage generation unit having at least first, second, third, and ground level output terminals and configured to generate the first voltage and the second voltage against a ground level, the third power line is connected to the third output terminal, the electric supply line drive unit is connected to the first output terminal and the second output terminal, the voltage generation unit is configured to output the first voltage to the first output terminal and the third output terminal before the second switching transistors are turned ON, and the electric supply line drive unit is configured to turn the second switching transistors ON while the voltage generation unit outputs the first voltage to the first output terminal and the third output terminal, to cause the power supply unit to supply the same voltage to the first power lines and the third power line.

5. The image display apparatus according to claim 3, comprising a drive unit including the electric supply line drive unit, wherein the drive unit is further configured to selectively output a reference voltage and a signal voltage to each of the signal lines and output a scanning signal for turning the first switching transistor ON or OFF to each of the signal lines, the second voltage is lower than the reference voltage by a threshold voltage of the drive transistor or more, and the drive unit is configured to perform:

a reset operation of setting the gate terminal of the drive transistor at the reference voltage and setting a potential of the other of the source terminal and the drain terminal of the drive transistor to the second voltage by supplying the second voltage to the first power line, supplying the reference voltage to the signal line, and turning the first switching transistor ON;

a threshold voltage detection operation of changing a difference in voltage between the gate terminal of the drive transistor and the other of the source terminal and the drain terminal of the drive transistor to a voltage corresponding to the threshold voltage of the drive transistor by supplying the first voltage to the first power line, supplying the reference voltage to the signal line, and turning the first switching transistor ON after the reset operation; and a write operation of setting the difference in voltage between the gate terminal of the drive transistor and the other of the source terminal and the drain terminal of the drive transistor to a sum of the signal voltage and the voltage corresponding to the threshold voltage by supplying the first voltage to the first power line, supplying the signal voltage to the signal line, and turning the first switching transistor ON after the reset operation.

6. The image display apparatus according to claim 1, wherein the second switching transistors are disposed in a one-to-one correspondence with the pixels.

7. The image display apparatus according to claim 1, wherein the number of the second switching transistors is smaller than the number of the pixels.

8. The image display apparatus according to claim 7, the pixels include:

a red pixel which emits red light;

a green pixel which emits green light; and a blue pixel which emits blue light, and the second switching transistors are disposed in units of the pixels, each of the units including the red pixel, the green pixel, and the blue pixel.

9. The image display apparatus according to claim 7, wherein the second switching transistors are disposed in a staggered manner.

10. The image display apparatus according to claim 1, wherein the third power line is composed of third power line portions disposed in the respective columns, and the other of the source terminal and the drain terminal of each of the second switching transistors is connected to one of the third power line portions that is disposed in a corresponding one of the rows.

11. The image display apparatus according to claim 1, wherein the third power line forms a grid.

12. The image display apparatus according to claim 1, wherein the third power line forms a plane which covers the pixels.

13. The image display apparatus according to claim 1, wherein the third power line is composed of third power line portions disposed in the respective rows, and wiring resistance of each of the third power line portions is smaller than wiring resistance of each of the first power lines.

* * * * *